US006423164B1

(12) United States Patent
Bryant et al.

(10) Patent No.: US 6,423,164 B1
(45) **Date of Patent: *Jul. 23, 2002**

(54) METHOD OF MAKING HIGH STRENGTH ALUMINUM SHEET PRODUCT AND PRODUCT THEREFROM

(75) Inventors: J. Daniel Bryant, Midlothian; Robert M. Ramage; Armand J. Beaudoin, both of Richmond, all of VA (US); Hidetoshi Uchida; Hideo Yoshida, both of Nagoya (JP)

(73) Assignee: Reynolds Metals Company, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/560,138

(22) Filed: Nov. 17, 1995

(51) Int. Cl.[7] ..... C22F 1/04

(52) U.S. Cl. ..... 148/552; 148/511; 148/510; 148/693

(58) Field of Search ..... 148/511, 510, 148/552, 693

(56) References Cited

U.S. PATENT DOCUMENTS

| | | | | |
|---|---|---|---|---|
| 2,070,833 | A | 2/1937 | Keller et al. | 148/700 |
| 3,945,861 | A | 3/1976 | Anderson et al. | 148/690 |
| 4,000,007 | A | 12/1976 | Develay et al. | 148/523 |

(List continued on next page.)

FOREIGN PATENT DOCUMENTS

| | | |
|---|---|---|
| FR | 905616 | 4/1945 |
| GB | 768097 | 2/1957 |
| JP | 9500200 | 2/1995 |

OTHER PUBLICATIONS

Recent Studies Into the Mechanism of Ridging in Ferritic Stainless Steels, Hung–Chi Chao, Metallurgical Transactions—vol. 4, Apr. 1973, pp. 1183–1186.

Effects of Grain Anisotrophy on Limit Strains in Biaxial Stretching: Part II. Sheets of Cubic Metals and Alloys with Well–Developed Preferred Orientations, D. V. Wilson, W. T. Roberts, and P.M.B. Rodrigues, Metallurgical Transactions A, vol. 12A, Sep. 1981, pp. 1603–1611.

(List continued on next page.)

*Primary Examiner*—M. Alexandra Elve
(74) *Attorney, Agent, or Firm*—Thomas R. Trempus; Christopher W. Brody; Matthew W. Smith

(57) ABSTRACT

A method of producing aluminum alloy sheet product includes casting a slab or ingot, homogenizing the cast slab, and hot rolling the homogenized slab to provide an intermediate gauge product. The temperature and other operating parameters of the hot rolling process are controlled so that the temperature of the ingot at the beginning of hot rolling is maintained at a temperature between 925° F. (496° C.) and 1025° F. (552° C.), and the temperature of the intermediate gauge product exiting the hot rolling step is between about 500° F. (260° C.) and 600° F. (316° C.). The intermediate gauge product is then subjected to a cold reduction of 45% to 70%, annealed, and cold rolled to final gauge. The combination of controlling the hot rolling to provide the desired hot line entry temperature and the desired exit temperature of the intermediate gauge product and annealing prior to cold rolling to final gauge minimizes or eliminates the appearance of ridging line defects in the aluminum sheet product when the product is subjected to further straining in a forming operation. An improved aluminum alloy sheet product is produced having a superior surface finish for use in automotive components while maintaining a higher strength than that of the prior art.

14 Claims, 4 Drawing Sheets

Flow Diagram of the Practice of the new invention

U.S. PATENT DOCUMENTS

| | | | | | |
|---|---|---|---|---|---|
| 4,081,294 | A | * | 3/1978 | Thompson et al. | 148/11.5 |
| 4,082,578 | A | | 4/1978 | Evancho et al. | 148/535 |
| 4,151,013 | A | | 4/1979 | Thompson et al. | 148/439 |
| 4,269,632 | A | | 5/1981 | Robertson et al. | 148/550 |
| 4,282,044 | A | * | 8/1981 | Robertson et al. | 148/2 |
| 4,424,084 | A | | 1/1984 | Chisholm | 148/417 |
| 4,486,244 | A | | 12/1984 | Ward et al. | 420/902 |
| 4,528,042 | A | | 7/1985 | Ward et al. | 420/902 |
| 4,614,552 | A | | 9/1986 | Fortin et al. | 148/417 |
| 4,626,294 | A | | 12/1986 | Sanders et al. | 148/493 |
| 4,699,673 | A | | 10/1987 | Kobayashi et al. | 148/693 |
| 4,784,921 | A | | 11/1988 | Hyland et al. | 148/417 |
| 4,808,247 | A | | 2/1989 | Komatsubara et al. | 148/415 |
| 4,897,124 | A | | 1/1990 | Matsuo et al. | 148/415 |
| 4,909,861 | A | | 3/1990 | Muraoka et al. | 148/439 |
| 4,921,548 | A | | 5/1990 | Cho | 148/415 |
| 4,946,517 | A | | 8/1990 | Cho | 148/415 |
| 5,019,188 | A | | 5/1991 | Hasenclever | 420/535 |
| 5,021,106 | A | | 6/1991 | Iwai et al. | 148/437 |
| 5,062,901 | A | | 11/1991 | Tanaka et al. | 148/417 |
| 5,080,728 | A | | 1/1992 | Hasenclever | 148/437 |
| 5,098,490 | A | | 3/1992 | Huu | 148/415 |
| 5,104,465 | A | | 4/1992 | McAuliffe et al. | 148/439 |
| 5,106,429 | A | | 4/1992 | McAuliffe et al. | 148/437 |
| 5,110,545 | A | | 5/1992 | McAuliffe et al. | 420/534 |
| 5,116,428 | A | | 5/1992 | Hasenclever | 148/438 |
| 5,122,196 | A | | 6/1992 | Fernandez | 148/552 |
| 5,137,686 | A | | 8/1992 | Rioja et al. | 420/528 |
| 5,192,378 | A | * | 3/1993 | Doherty et al. | 148/691 |
| 5,194,101 | A | | 3/1993 | Worcester et al. | 148/671 |
| 5,213,639 | A | | 5/1993 | Colvin et al. | 148/693 |
| 5,223,055 | A | | 6/1993 | Charquet et l. | 148/672 |
| 5,240,522 | A | | 8/1993 | Tanaka et al. | 148/693 |
| 5,480,498 | A | * | 1/1996 | Beaudoin et al. | 148/549 |
| 5,580,402 | A | | 12/1996 | Fujita et al. | |

OTHER PUBLICATIONS

Texture Inhomogeneity and Limit Strains in Aluminum Sheet, P. S. Bate, IRC in Material for High Performance Applications, The University of Birmingham, Scripts Metallurgica et Materialia, vol. 27, pp. 515–520, 1992.

On the Effect of Copper, Magnesium and Silicon Content on the Properties of Al–CU–MG Alloys, Lilienthal Company for Aviation Research on Feb. 14, 1938 in Berlin (trans.).

* cited by examiner

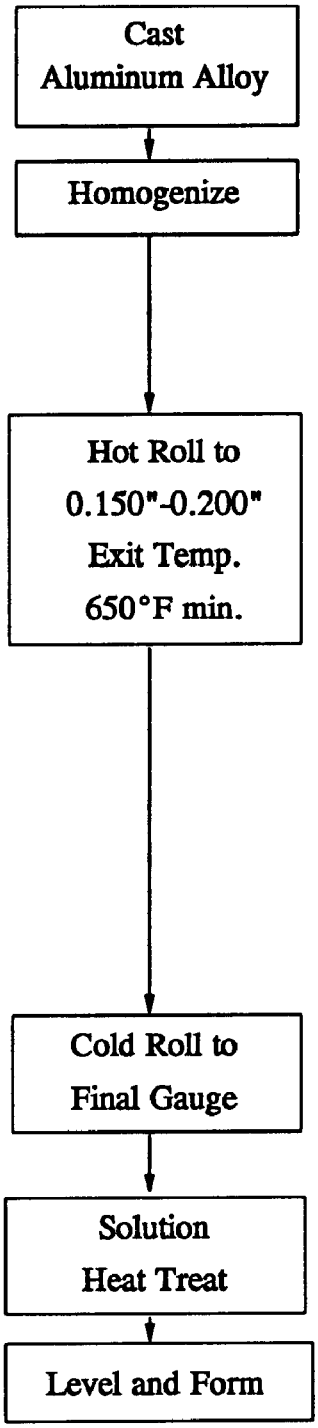
Fig. 1: Flow Diagram of Prior Art Practice
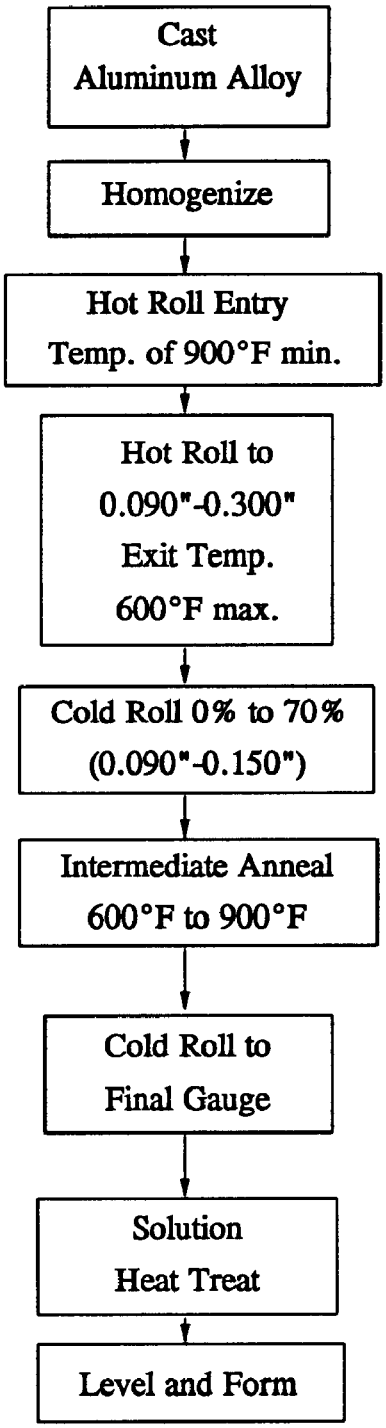
Fig. 2: Flow Diagram of the Practice of the new invention

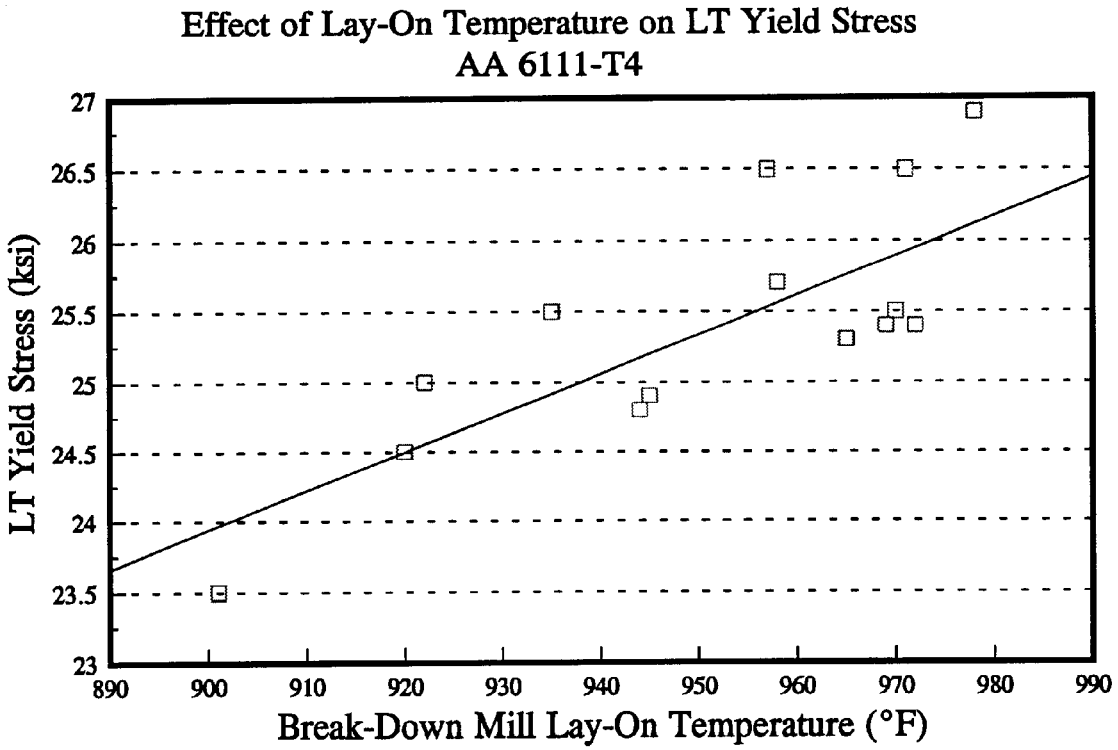
Fig. 3: LT yield stress plotted as a function of hot mill lay-on temperature for the data of Example 1

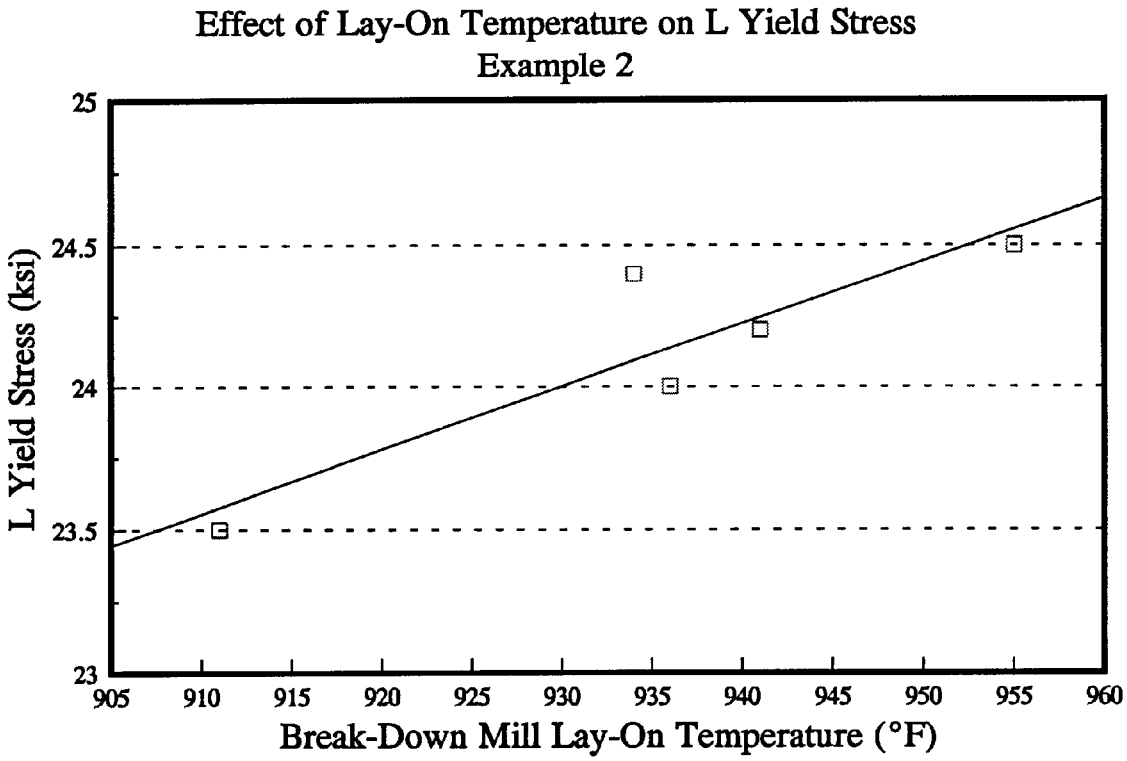
Fig. 4: L yield stress plotted as a function of hot mill lay-on temperature for the data of Example 2

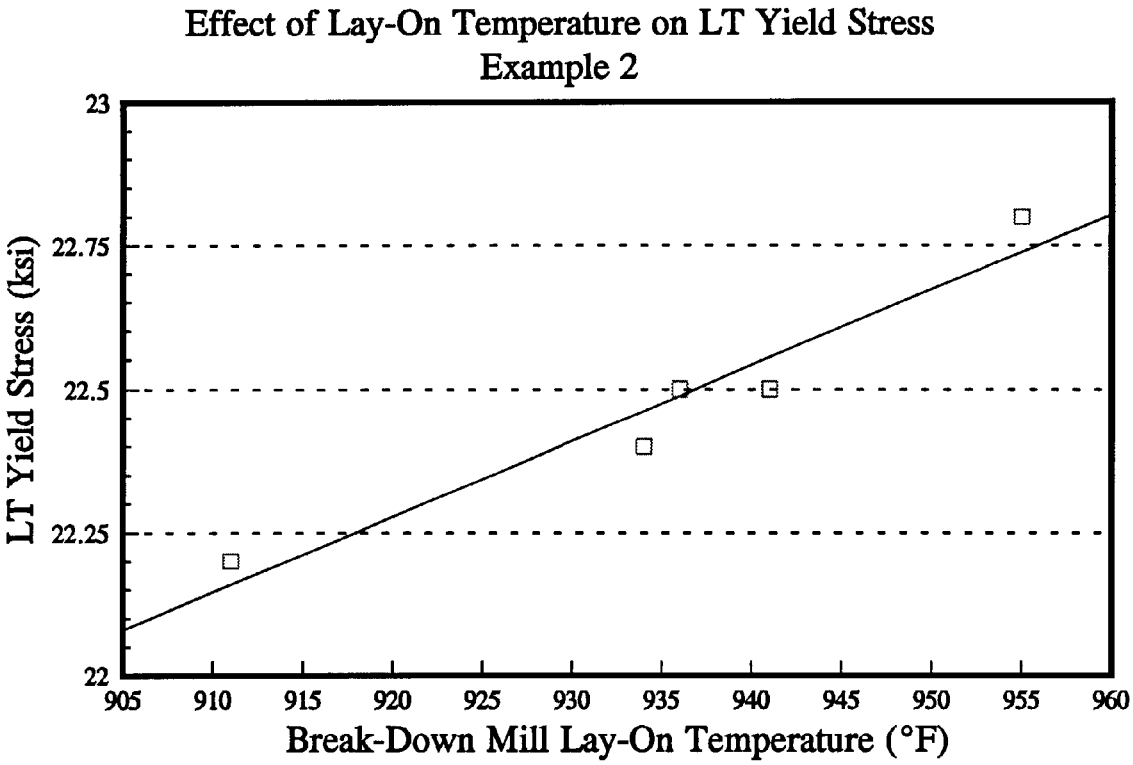
Fig. 5: LT yield stress plotted as a function of hot mill lay-on temperature for the data of Example 2

METHOD OF MAKING HIGH STRENGTH ALUMINUM SHEET PRODUCT AND PRODUCT THEREFROM

FIELD OF THE INVENTION

The present invention is directed to a method of making aluminum sheet product and products therefrom and, in particular, to a method of controlling hot rolling entry temperatures and hot rolling exit temperatures during automotive sheet processing to produce a high strength final gauge product in which certain surface defects, referred to as ridging, have been minimized or eliminated.

BACKGROUND ART

In the automotive industry, the use of aluminum alloys for automotive applications is increasing due to their desirable combination of properties such as low density, high strength, corrosion resistance, and formability.

Typically, automotive body sheet products are approximately 0.04" (1.0 mm) in thickness and include 2000 and 6000 series aluminum alloys. Preferred 2000 series aluminum alloys include, but are not limited to, AA2008, AA2010, and AA2036. Preferred 6000 series aluminum alloys include, but are not limited to, AA6009, AA6010, AA6016, and AA6111. Outer body panel applications require high strength, typically to improve dent resistance, and superior surface appearance, to ensure that no discontinuities are visible after paint has been applied. Inner body panel applications do not require the strength levels or surface appearance necessary for outer body panel applications; however, formability is a critical concern because of the complex nature of most inner body panel designs.

With reference to FIG. 1, a typical prior art processing sequence is depicted for making aluminum sheet. Ingots of the aluminum alloy are cast, homogenized and hot rolled to a desired gauge, such as approximately 0.18" (4.6 mm). Typically, the homogenized ingot enters the hot rolling step at a temperature of approximately 850°F. (454° C.)to 1000° F. (538° C.) and exits at temperatures generally greater than 650° F. (343° C.). The hot rolled material is then cold rolled to final gauge, solution heat treated, leveled, and formed for its desired end use. The material may be subjected to an anneal either prior to the cold rolling or after completion of a portion of the cold rolling. U.S. Pat. No. 4,614,552, titled ALUMINUM ALLOY SHEET PRODUCT, the contents of which are herein incorporated by reference, describes conventional prior art practice for producing AA6111 alloys. U.S. patent application Ser. No. 08/246,653, filed May 20, 1994, titled METHOD OF MAKING ALUMINUM SHEET PRODUCT AND PRODUCT THEREFROM and Japanese Application No. 6-41850 of Feb. 16, 1994, titled METHOD OF PRODUCING ALUMINUM ALLOY SHEET HAVING HIGH FORMABILITY.

One drawback associated with the use of aluminum alloys for automotive components is the possible presence of objectionable and/or deleterious surface defects referred to as ridging, roping, or paint brush lines, which appear on the surface of stamped or formed aluminum sheet components. The ridging lines are present on the surface of the automotive component as a series of closely spaced lines in the rolling direction. Typically, the ridging lines are approximately 0.2 microns high and are spaced less than approximately 1 mm apart. The ridging or roping lines appear in the rolling direction only upon application of sufficient transverse strain, such as that occurring in typical stamping or forming operations.

This ridging defect when present is of sufficient severity to be visible in the automotive component after painting. Consequently, the finished surface appearance of components made from these aluminum alloys is objectionable and not suitable for exterior automotive applications. This ridging defect may also serve as a strain concentration site during forming, thus limiting formability.

In view of the problems with automotive components processed using aluminum sheet made with prior art practices, a need has developed to eliminate the ridging line defects in aluminum alloy sheet products. Elimination of this defect should encourage increased application of aluminum alloys.

In response to the preceding, the present invention provides an improved sheet product and a method of making aluminum alloy sheet product, especially for automotive use, which minimizes or eliminates the occurrence of ridging lines while maintaining the potential for high strength in the naturally aged and artificially aged conditions. The inventive method produces an aluminum alloy sheet product which can be stamped or formed and painted for automotive use without an objectionable surface appearance having defects, such as ridging or roping lines.

SUMMARY OF THE INVENTION

Accordingly, a first object of the present invention is to provide a method of making aluminum alloy sheet product which eliminates or minimizes ridging lines in the finished product without compromising the strength of the finished product.

Another objective of the present invention is to provide a method of making aluminum alloy sheet product which also improves the formability of the sheet for subsequent forming and/or stamping.

Other objects and advantages of the present invention will become apparent as a description thereof proceeds.

In satisfaction of the foregoing objects and advantages, the present invention provides an improvement over the prior art method of producing aluminum alloy sheet product, especially for automotive use, wherein the aluminum alloy is cast, homogenized, hot rolled to an intermediate gauge, cold rolled to final gauge, and solution heat treated for subsequent automotive component use. It should be appreciated that reference to the term "automotive" is intended to encompass similar applications, such as for light truck component use.

According to the invention, the temperature of the hot rolling of the aluminum alloy and other process parameters are controlled so that the temperature of the ingot entering the hot mill is greater than 925° F. (496° C.) and the temperature of the aluminum alloy exiting the rolling mill is less than about 600° F. (316° C.). The hot rolled product is then cold rolled to final gauge, with the application of an intermediate anneal following cold rolling of the hot line product between 0% and 70% of the total cold rolling reduction. In one embodiment, it is preferred that the temperature of the ingot upon entering the hot mill be greater than 950° F. (510° C.) and the temperature of the intermediate product exiting the hot mill not exceed 575° F. (302° C.).

In the embodiment wherein the sheet is annealed after 0% cold work, a preferred annealing temperature ranges between 700° F. (371° C.) and 800° F. (427° C.) for about two hours. In the alternative embodiment wherein the intermediate gauge sheet is annealed after about 45% to 70% cold work, a preferred annealing temperature range is between 600° F. (316° C.) and 700° F. (371° C.) for about two hours.

Preferably, the aluminum alloy used in the inventive process is either an AA6000 series or an AA2000 series alloy, more preferably, an AA6111 type alloy. However, any aluminum alloy adaptable for sheet use can be utilized in the invention.

The inventive method produces an intermediate product in the form of a hot rolled band which can be subsequently annealed and cold rolled to a final gauge sheet product devoid of or having a minimum of ridging or roping lines on the surface thereof. The invention also provides a final cold rolled gauge sheet product which can be solution heat treated, leveled, and formed as an automotive component.

BRIEF DESCRIPTION OF THE DRAWINGS

Reference is now made to the accompanying drawings wherein:

FIG. 1 is a schematic drawing of a prior art process for making aluminum alloy sheet;

FIG. 2 is a schematic diagram depicting the inventive method for producing aluminum alloy sheet;

FIG. 3 depicts LT yield strength plotted as a function of hot mill lay-on temperature;

FIG. 4 depicts longitudinal yield strength plotted as a function of hot mill lay-on temperature; and FIG. 5 depicts LT yield stress plotted as a function of hot mill lay-on temperature.

DESCRIPTION OF THE PREFERRED EMBODIMENTS

Producing aluminum alloy sheet according to the present invention eliminates or minimizes the ridging defect known as ridging, roping, or paint brush lines in aluminum sheet product, in particular, automotive sheet while maintaining the potential to produce a high strength product in either the naturally aged or artificially aged condition.

According to the invention, the high strength of the final gauge product is ensured by maintaining a high hot line entry temperature. The ridging lines which present an objectionable surface appearance, especially in automotive applications, are eliminated or minimized at final gauge by controlling the hot rolling operation of a cast and homogenized ingot or slab so that the temperature of the aluminum alloy sheet exiting hot rolling falls within a desired range. The hot rolled aluminum sheet is then annealed in conjunction with cold rolling to final gauge. The final gauge aluminum sheet product, when strained, does not exhibit an objectionable amount of ridging, roping, or paint brush lines typically found in prior art aluminum sheet.

With reference now to FIG. 2, an aluminum alloy, preferably an AA2000 or AA6000 series alloy, is cast and homogenized according to conventional practice. Typically, the alloy is cast as an ingot, scalped, and homogenized at high temperature for an extended period of time, for example, 1000° F. (538° C.) to 1050° F. (566° C.) for approximately 2 to 24 hours.

Since the casting and homogenizing steps are conventional for these types of alloys, further discussion in conjunction with the invention is not deemed necessary.

After the homogenization step, the cast aluminum alloy slab or ingot is hot rolled to an intermediate gauge ranging between about 0.09 inches (2.3 mm) and 0.30 inches (7.6 mm).

During hot rolling, temperatures and other operating parameters are controlled so that the temperature of the aluminum alloy upon entering the hot mill is maintained between 925° F. (496° C.) and 1025° F. (552° C.). Preferably, the entry temperature into the hot mill is between 950° F. (510° C.) and 1025° F. (552° C.). The temperature of the ingot upon entry into the hot mill is believed to control the strength of the final product in the naturally aged and artificially aged conditions. The hot rolling process is controlled so that the temperature of the hot rolled intermediate product upon exit from the hot rolling mill is lower than 600° F. (316° C.). Preferably, the temperature does not exceed 575° F. (302° C.) and may be less than 500° F. (260° C.). As will be described below, controlling the hot rolling step is believed to provide a microstructure which, when further processed, does not form the ridging line defect at final gauge.

Controlling the entry temperature of the aluminum ingot is achieved either by rolling the ingot directly from the homogenization cycle or by re-heating the homogenized ingot. The temperature of the ingot to be hot rolled can be monitored using known techniques, such as contact thermocouples or optical pyrometry. With reference to FIG. 2, in one embodiment, the cast aluminum alloy enters the hot rolling mill at a temperature of about 925° F. (496° C.) to 1020° F. (549° C.), and with a preferred temperature of about 950° F. (510° C.) to 1020° F. (549° C.).

Controlling the hot rolling process to provide the desired exit temperature of the hot rolled aluminum alloy intermediate product can be done using any one or a combination of conventional practices, such as through control of the hot mill cooling lubricant, rolling speed, or time delays between the various steps on a typical hot mill. The temperature of the hot rolled intermediate product can be monitored using known techniques, such as contact thermocouples or optical pyrometry. The monitored hot mill exit temperature can be used in a feedback control manner in conjunction with cooling the slabs or controlling temperatures during hot rolling using cooling lubricants, mill speeds, or the like as described above. That is the mill exit temperature can dictate adjustment in the rolling operation to maintain the exit temperature within the specified range.

Still with reference to FIG. 2, in one embodiment, the cast aluminum alloy is hot rolled to an intermediate gauge of less than 0.18" (4.6 mm), with a preferred thickness of 0.13" (3.3 mm) and a preferred exit temperature of about 500°F. (260° C.) to 575° F. (302° C.). The hot rolling step can be performed using any conventional hot rolling mill capable of reducing the cast aluminum alloy material to the desired intermediate gauge.

Following hot rolling, the hot rolled intermediate product, which may be sheet or plate, is subject to an intermediate anneal, following 0% cold work, at a predetermined temperature and time prior to cold rolling to final gauge. Preferred temperatures and times range from 700° F. (371° C.) to 900° F. (482° C.) for up to 18 hours.

An alternative embodiment includes hot rolling the cast aluminum alloy to an intermediate gauge of 0.18 inches (4.6 mm) to 0.30 inches (7.6 mm) at the exit temperature less than 600° F. (316° C.), preferably less than 575° F. (302° C.). The hot rolled intermediate gauge aluminum alloy product is then cold rolled to a second intermediate gauge, ranging between 0.09 inches (2.3 mm) and 0.15 inches (3.8 mm), followed by an intermediate anneal at a predetermined time and temperature. The intermediate gauge annealed product is then cold rolled to final gauge. Preferred times and temperatures for the intermediate gauge anneal include 600° F. (316° C.) to 900° F. (482° C.) for up to 12 hours.

As discussed above, prior art processing techniques, wherein the hot rolled material exits the hot mill at a typical minimum temperature of 650° F. (343° C.) and is directly cold rolled to final gauge, result in materials subject to ridging or roping lines in the final product. It is believed that the source of these ridging lines is related to a textural banding in the product. That is, the ridging lines consist of a band of grains having a similar orientation, specifically, a (100)<001> crystallographic texture. Although the origin of these bands of grains is not clearly understood, it is believed that the bands of similar orientation act like a large single grain during deformation. Specifically, the individual grains in the separated bands experience similar grain rotations at the free surface, comparable to the mechanism causing the appearance of "orange peel" after straining sheet metal with large grains. These bands of grains, that have similar rotations at the free surface, are visible on the strained sheet as lines or ridges, thereby producing unattractive and detrimental surface relief.

To overcome this problem, the inventive method utilizes a high hot line entry temperature combined with a low hot line exit temperature. By controlling the hot rolling process in this way, the inventive method is superior to that of the prior art in that detrimental surface relief can be avoided without a compromise in the strength of the final product. Maintaining higher temperatures during the initial stages of hot rolling has been seen to result in superior strength. Lower hot working temperatures in the final passes of the hot mill result in increased amount of solute precipitation, a retention of a wrought structure, and greater potential for a more random arrangement of grain orientation in the structure upon subsequent annealing. The warm worked structure can then be used to promote the nucleation and growth of grains with a more random distribution of orientations during a subsequent annealing step, thus preventing the formation of textural bands.

By lowering the hot line exit temperature and performing sufficient reduction of the intermediate product exiting the hot rolling step, it is believed that the aluminum material is unable to recover sufficiently from the rolling deformation, thereby providing a structure having an increased number of nucleation sites, as well as stored energy, for recrystallization of grains with different orientations. The lower exit temperature in the hot rolling step is also believed to contribute to the precipitation of particles in the material, such as magnesium silicide compounds in AA6111, these precipitate particles offering additional sites for nucleation of randomly oriented grains. The formation of numerous and randomly oriented grains effectively interrupts the creation of bands of similarly oriented grains which are believed to contribute to the ridging line defect. Since the similarly oriented bands of grains do not form, they cannot buckle uniformly upon straining to develop surface relief.

For the intermediate anneal shown in FIG. 2, the annealing temperature should be sufficiently high and for a sufficient length of time to promote the necessary recrystallization described above, while avoiding excessive surface oxidation or excessive grain growth, which may result in increased susceptibility of the final product to develop "orange peel" upon straining. As will be described below, the annealing practices demonstrated in the examples did not generate oxide or orange peel problems.

Preferably, the annealing temperature range for hot rolled sheet ranging in gauges from 0.13 inches (3.3 mm) to 0.15 inches (3.8 mm), with 0% subsequent cold work, is 750° F. (399° C.) to 800° F. (427° C.) for about two hours. The annealing temperature range for hot rolled sheet ranging in gauges from 0.18 to 0.30" (4.6–7.6 mm) which has experienced 45% to 70% cold work following hot rolling, is 650° F. (343° C.) to 700° F. (371° C.) for approximately two to three hours.

Following the cold rolling to final gauge, typically between 0.016" (0.4 mm) and 0.065" (1.7 mm), ideally about 0.04" (1.0 mm), the aluminum sheet is solution heat treated, leveled and formed or stamped in its desired end use configuration.

The solution heat treatment should be the conventional treatment for the alloy which results in solutionizing of the strengthening phase. For example, an AA6111 aluminum alloy product when subjected to the inventive processing is subsequently given a solution heat treatment, quenched, and naturally aged.

The forming step can be any conventional type such as stamping wherein the final gauge aluminum alloy sheet is formed to a desired configuration.

EXAMPLE 1

In order to demonstrate the elimination of ridging line defects in the final gauge aluminum sheet product, the following experiments were conducted. It should be understood that reference to percentages of alloy elements is in weight percent unless otherwise noted. In addition, the experiments are intended to be representative of the inventive method and product and are not to be considered as limiting the invention.

With reference to Table I, 15 lots of AA6111 were cast, homogenized and hot rolled to investigate the presence or absence of paint brush lines in the final gauge product.

The alloy composition ranges of the lots were cast to AA6111 specifications - Si: 0.60–1.1, Fe: 0.40 max., Cu: 0.50–0.9, Mn: 0.10–0.45, Mg: 0.5–1.0, Cr: 0.10 max., and Zn: 0.15 max.

The aluminum alloy lots were cast into ingots, scalped and homogenized for 34 hours between 1,000° F. and 1,050° F. (538 and 566° C.)

The homogenized ingots or slabs were then hot rolled following the sequence: ingot breakdown reversing mill—intermediate reversing mill—five stand tandem mill. The hot line lay-on temperature ranged between 901° F. (483° C.) and 972° F. (522° C.).

Table I also shows the entry temperature and mill speed for the tandem finishing mill for each of the lots. Exit temperatures ranged between 560° F. (293° C.) and 727° F. (386° C.). The exit temperature was varied by letting the slabs cool on the roller table and/or adjusting the speed of the tandem finishing mill.

The exit gauge of the hot rolled sheet was varied between 0.13" (3.3 mm), 0.18" (4.6 mm) and 0.25" (6.4 mm). At gauges of .13" (3.3 mm) and 0.18" (4.6 mm), the hot line product was either rolled directly to final gauge or given an anneal prior to any cold work and then cold rolled to final gauge. The 0.25" (6.4 mm) gauge hot line product was given a cold reduction annealed, and then cold rolled to final gauge.

TABLE I

| Lot No. | Break-Down Mill Lay-On Temp. [° F.] | Tandem Mill mill speed [feet/min.] | Tandem Mill Exit Temp. [° F.] | Tandem Mill Exit gauge [in.] | % Cold Work Before Annealing | LT Yield Stress (ksi) | Ridging Line Susceptibility |
|---|---|---|---|---|---|---|---|
| | Process Conditions | | | | | | |
| 1 | 972 | 800 | 727 | 0.18 | N/A | 25.4 | yes |
| 2 | 971 | 825 | 710 | 0.18 | 0% | 26.5 | yes |
| 3 | 969 | 850 | 677 | 0.13 | N/A | 25.4 | yes |
| 4 | 978 | 850 | 674 | 0.13 | 0% | 26.9 | yes |
| 5 | 965 | 800 | 656 | 0.13 | N/A | 25.3 | yes |
| 6 | 970 | 750 | 636 | 0.13 | N/A | 25.5 | yes |
| 7 | 972 | 750 | 634 | 0.13 | N/A | 25.4 | yes |
| 8 | 958 | 750 | 677 | 0.18 | N/A | 25.7 | yes |
| 9 | 957 | 675 | 652 | 0.18 | N/A | 26.5 | yes |
| 10 | 945 | 600 | 623 | 0.18 | 0% | 24.9 | yes |
| 11 | 935 | 550 | 609 | 0.18 | N/A | 25.5 | yes |
| 12 | 944 | 550 | 600 | 0.18 | N/A | 24.8 | yes |
| 13 | 920 | 500 | 591 | 0.25 | 48% | 24.5 | no |
| 14 | 922 | 740 | 596 | 0.13 | N/A | 25.0 | yes |
| 15 | 901 | 760 | 560 | 0.13 | 0% | 23.5 | no |

As can be seen from Table I, Lot Nos. 2, 4, 10 and 15 were given an anneal prior to any cold rolling with Lot No. 13 receiving an anneal after a 48% cold reduction.

Table I also shows that each of the lot numbers, except Nos. 13 and 15, exhibited ridging line susceptibility as will be further described herein below.

The coils given the hot line anneal were heated for about 2½ hours at between 750° and 800° F. (399° and 427° C.) followed by furnace cooling to 450° F. (232° C.) and air cooling to room temperature. Except for Lot No. 13, each of the lots was cold rolled to final gauge of 0.041" (1.0 mm) using conventional cold rolling techniques.

Lot 13 was cold rolled to 0.13" (3.3 mm), given an intermediate anneal for two hours between 650° F. and 700° F. (3430 and 371° C.) and then cold rolled to final gauge.

Each lot number was then given a conventional solution heat treatment and quench for AA6111 alloys.

Each of the lot numbers was then investigated for ridging line susceptibility. In this evaluation, two ridging line tests were used for evaluation purposes. A first test involved buffing a one-inch wide strip, straining this strip 2% in the LT direction and observing the severity of the ridging lines formed on the strip surface optically. A second test comprised forming pans of the aluminum alloy sheet product that are typically used for evaluating dent resistance and observing the severity of ridging line formation in the strained regions of the pan.

As is evident from Table I, each of the lots except Nos. 13 and 15 exhibited ridging line susceptibility.

In an alternative ridging line evaluation, Lot Nos. 1 and 15 were used to form automotive car hoods. The car hoods formed from Lot No. 15 did not exhibit ridging lines whereas hoods formed from Lot No. 1, produced using prior art processing, did exhibit ridging lines.

The results of Table I indicate that ridging lines can be eliminated by maintaining a lower exit temperature coming off the hot rolling mill followed by a subsequent anneal, following a 0% reduction at hot roll exit gauges less than or equal to 0.15" (3.8 mm) or following a 48% cold reduction to the hot rolled material.

The practice described above for the elimination of ridging lines relies on a lower exit temperature, which in these experiments was often achieved through a lowering of the break-down mill lay-on temperature. When lower exit temperatures were combined with lower lay-on temperatures, however, it was found that yield strength decreased. The transverse yield strength of the T4 product for each of the 15 practices is provided in Table 1. These data may be correlated to the break-down mill lay-on temperatures, as shown in FIG. 3. From these data, it is clear that the need remains for a practice which can provide a ridging line free alloy while maintaining a high strength final product.

EXAMPLE 2

In order to demonstrate the elimination of ridging line defects in the final gauge aluminum sheet product while exploiting the full strength potential of the alloy, the following experiment was conducted.

With reference to Table II, 5 ingots of AA6111 were cast, homogenized and hot rolled to investigate the appearance or absence of paint brush lines in the final gauge product and the effect of break-down mill lay-on temperature on final T4 yield strength.

The alloy composition ranges of the lots were cast to AA6111 specifications—Si: 0.60–1.1, Fe: 0.40 max., Cu: 0.50–0.9, Mn: 0.10–0.45, Mg: 0.5–1.0, Cr: 0.10 max., and Zn: 0.15 max., the balance incidental impurities and aluminum.

The aluminum alloy lots were cast into ingots, scalped and homogenized for 24 hours between 1,000° F. (538° C.) and 1,050°F. (566° C.).

The homogenized ingots were then hot rolled following the sequence: ingot breakdown reversing mill—intermediate reversing mill—four stand tandem mill. The hot line lay-on temperature ranged between 911° F. (488° C.) and 955° F. (513° C.)

Table II also shows the entry temperature and mill speed for the tandem finishing mill for each of the lots. Exit temperatures ranged between 552° F. (289° C.) and 575° F. (302° C.). The exit temperature was varied by letting the slabs cool on the roller table and/or adjusting the speed of the tandem finishing mill.

The exit gauge of the hot rolled sheet was 0.13" (3.3 mm). The hot line product was given an anneal at 750° F. (399° C.)–800° F. (427° C.) for 2½ hours prior to any cold work and then cold rolled to final gauge.

TABLE II

| Process Conditions | | | | | | |
|---|---|---|---|---|---|---|
| Lot No. | Break-Down Mill Lay-On Temp. [° F.] | Tandem Mill Exit Temp. [° F.] | Tandem Mill Exit gauge [in.] | L YS (ksi) | LT YS (ksi) | RLS |
| 1 | 911 | 575 | 0.13 | 23.5 | 22.2 | no |
| 2 | 934 | 552 | 0.13 | 24.4 | 22.4 | no |
| 3 | 936 | 556 | 0.13 | 24.0 | 22.5 | no |
| 4 | 941 | 561 | 0.13 | 24.2 | 22.5 | no |
| 5 | 955 | 573 | 0.13 | 24.5 | 22.8 | no |

In Table II, "L YS" and "LT YS" refer to average longitudinal yield strength and average transverse yield strength, respectively. The column marked "RLS" refers to ridging line susceptibility.

Each of the lot numbers was then investigated for ridging line susceptibility and tensile strength in the final T4 temper in two orientations with respect to the rolling direction: longitudinal (L) and transverse (LT). In this evaluation, a single ridging line test was used for evaluation purposes. The test involved buffing a one-inch wide strip, straining this strip 2% in the LT direction and observing the severity of the ridging lines formed on the strip surface optically.

The results of Table II indicate that ridging lines can be eliminated by maintaining a lower exit temperature coming off the hot rolling mill followed by a subsequent anneal. As shown in FIGS. 4 and 5, increasing lay-on temperature (as measured at the entrance to the break-down mill) was associated with increasing yield strength in the final product. Even over the limited range of lay-on temperatures investigated (911° F. (488° C.) through 955° F. (513° C.)), an improvement of 1 ksi in longitudinal yield strength was measured. Further improvements in yield strength are anticipated at higher lay-on temperatures.

Although a final gauge product of 0.04" (1.0 mm) was exemplified in the experiments discussed above, it is contemplated that the inventive processing can be utilized to produce aluminum sheet product in final gauge thicknesses ranging between 0.015" (0.4 mm) to 0.065" (1.7 mm).

As such, an invention has been disclosed in terms of preferred embodiments thereof which fulfill each and every one of the objects of the present invention and provide an improved method for making aluminum alloy sheet products and sheet products therefrom. Of course, various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A method of producing an aluminum alloy sheet product comprising:

casting an aluminum alloy to provide a slab said aluminum alloy, by weight percent, consisting essentially of 0.60 to 1.1 Si, 0.40 max. Fe, 0.50 to 0.9 Cu, 0.10 to 0.45 Mn 0.5 to 1.0 Mg, 0.10 max Cr, 0.15 max Zn;

homogenizing the slab;

hot rolling the slab in a hot mill to provide an intermediate gauge product, the hot rolling process being controlled so that the temperature of a slab upon entering the hot mill is sufficiently high to maintain solute in solid solution and so that the slab is rolled to provide an intermediate gauge product exiting the hot rolling step at a temperature between about 500 ° F. (260° C.) and 600° F. (316° C.);

cold rolling the intermediate gauge product to a final gauge product; said intermediate product being subjected to one of:

annealing at a temperature of between 700° F. (371 ° C.) and 900° F. (482 ° C.) prior to cold rolling to the final gauge product, and cold rolling to provide a second intermediate gauge sheet product, annealing of said second intermediate gauge product between 600° F. (316° C.) and 900° F. (482° C.), and cold rolling of said annealed second intermediate gauge product to the final gauge product; and solution heat treating and quenching the final gauge product to provide an aluminum alloy sheet product, the method providing an aluminum alloy sheet product that, when subsequently strained, has a minimum of ridging lines formed on a surface thereof.

2. A method of producing an aluminum alloy sheet product comprising:

casting an aluminum alloy to provide a slabs said aluminum alloy by weight percent, consisting essentially of 0.60 to 1.1 Si, 0.40 max. Fe, 0.50 to 0.9 Cu, 0.10 to 0.45 Mn, 0.5 to 1.0 Mg, 0.10 max Cr. 0.15 max Zn;

homogenizing the slab;

hot rolling the slab in a hot mill to provide an intermediate gauge product, the hot rolling being controlled so that the temperature of the slab entering the hot mill is between 950° F. (510° C.) and 1025° F. (552° C.) and the temperature of the intermediate gauge product exiting the hot rolling step does not exceed 575° F. (302 ° C.);

cold rolling the intermediate gauge product to a final gauge product, said cold rolling including one of: (a) annealing said intermediate gauge product between 700° F. and 900 ° F. (371° C. and 482° C.) followed by cold rolling said annealed intermediate gauge product to the final gauge product; and (b) cold rolling said intermediate gauge product to provide a second intermediate gauge sheet product, annealing said second intermediate gauge product between 600 ° F. and 1000° F. (316° C. and 538 ° C.), and cold rolling said annealed second intermediate gauge product to the final gauge product; and solution heat treating and quenching the final gauge product to provide an aluminum alloy sheet product;

the process enabling the product to be subsequently strained while minimizing formation of ridging lines on a surface thereof.

3. The method of claim 2 wherein said second intermediate gauge sheet product is annealed at between 650° F. and 700° F. (343° C. and 371° C.).

4. The method of claim 1 wherein said hot rolling process is controlled so that temperature of the slab upon entering the hot mill is between 925° F. (496° C.)and 1025° F. (552° C.).

5. The method of claim 1 wherein said hot rolling process is controlled so that temperature of the slab upon entering the hot mill is between 950° F. (510° C.) and 1025° F. (552° C.).

6. The method of claim 1 further comprising cold rolling said intermediate gauge product to provide a second intermediate gauge sheet product and annealing said second intermediate gauge sheet product between about 600° F. (316° C.) and 800° F. (427° C.) and cold rolling to the final gauge.

7. The method of claim 1 wherein said hot rolling process is controlled so that the temperature of the intermediate gauge product is controlled between 500° F. (260° C.) and 575° F. (302° C.).

8. The method of claim 1 further comprising controlling said hot rolling process so that the temperature of the intermediate gauge product exiting the hot rolling step is less than about 575° F. (316° C.).

9. The method of claim 4 wherein said hot rolling process is controlled so that the intermediate gauge product has a gauge ranging between 0.13 inches (3.3 mm) and 0.18 inches (4.6 mm).

10. The method of claim 5 wherein said hot rolling process is controlled so that the intermediate gauge product has a gauge ranging between 0.18 inches (4.6 mm) and 0.30 inches (7.6 mm) and said cold rolling of said second intermediate gauge product is controlled so that said second intermediate gauge product has a gauge ranging between 0.09 inches (2.3 mm) and 0.18 inches (4.6 mm).

11. The method of claim 1 wherein said aluminum alloy is an AA6000 series or an AA2000 series alloy.

12. The method of claim 1 wherein said aluminum alloy is an AA6111 alloy.

13. The method of claim 1 further comprising the step of forming said aluminum alloy sheet product into an automotive component having a surface thereof substantially free from ridging lines.

14. The method of claim 1 wherein the gauge of said final gauge product is about 0.04 inches (1.0 mm).

* * * * *